US008558649B2

(12) United States Patent
Takaya et al.

(10) Patent No.: US 8,558,649 B2
(45) Date of Patent: Oct. 15, 2013

(54) ELECTROMAGNETIC CONTACT DEVICE

(75) Inventors: Kouetsu Takaya, Kounosu (JP); Koji Okubo, Kumagaya (JP); Yasuhiro Naka, Kounosu (JP); Toshikatsu Ohgami, Kumagaya (JP); Kenji Suzuki, Minami-Saitama-gun (JP)

(73) Assignee: Fuji Electric FA Components & Systems, Co., Ltd., Tokyo (JP)

( * ) Notice: Subject to any disclaimer, the term of this patent is extended or adjusted under 35 U.S.C. 154(b) by 0 days.

(21) Appl. No.: 13/138,729

(22) PCT Filed: Jun. 14, 2010

(86) PCT No.: PCT/JP2010/003934

§ 371 (c)(1),
(2), (4) Date: Feb. 6, 2012

(87) PCT Pub. No.: WO2011/021332

PCT Pub. Date: Feb. 24, 2011

(65) Prior Publication Data

US 2012/0146750 A1 Jun. 14, 2012

(30) Foreign Application Priority Data

Aug. 20, 2009 (JP) ..... 2009-190584

(51) Int. Cl.
*H01H 67/02* (2006.01)

(52) U.S. Cl.
USPC ..... 335/131

(58) Field of Classification Search
USPC ..... 335/78, 131
See application file for complete search history.

(56) References Cited

U.S. PATENT DOCUMENTS

| | | | | |
|---|---|---|---|---|
| T100904 | I4 * | 8/1981 | Kawamura | 335/131 |
| 4,654,744 | A | 3/1987 | Okado et al. | |
| 4,724,410 | A * | 2/1988 | Degenhart | 335/132 |
| 4,945,328 | A * | 7/1990 | Kinney et al. | 335/202 |
| 7,038,563 | B2 * | 5/2006 | Andoh et al. | 335/126 |
| 7,116,196 | B1 * | 10/2006 | Hirabayashi | 335/282 |
| 7,414,828 | B2 * | 8/2008 | Birner | 361/624 |
| 7,545,248 | B2 * | 6/2009 | Imanishi et al. | 335/202 |
| 7,570,138 | B2 * | 8/2009 | Hirabayashi | 335/131 |
| 7,679,477 | B2 * | 3/2010 | Portier | 335/132 |
| 2002/0145494 | A1 * | 10/2002 | Andoh et al. | 335/126 |
| 2006/0132268 | A1 * | 6/2006 | Hirabayashi | 335/126 |
| 2008/0122564 | A1 * | 5/2008 | Utsunomiya et al. | 335/202 |

FOREIGN PATENT DOCUMENTS

| | | |
|---|---|---|
| JP | S54-159079 | 11/1979 |
| JP | S57-006137 | 1/1982 |
| JP | H02-284325 | 11/1990 |
| JP | H04-233115 | 8/1992 |
| JP | 2000-090800 | 3/2000 |
| JP | 2008-300328 | 12/2008 |

* cited by examiner

*Primary Examiner* — Alexander Talpalatski
(74) *Attorney, Agent, or Firm* — Manabu Kanesaka

(57) ABSTRACT

An electromagnetic contact device has a terminal base (18) formed on one end of a coil frame around which a winding of an electromagnetic coil is wound; a terminal (20*a*) which can be connected to external wiring, and a winding wire binding portion (20*e*) which can bind an end portion of the winding, wound around the coil frame to establish connection. The coil terminal (20) is a component formed by integrating the terminal (20*a*), the winding wire binding portion (20*e*), and a portion to be engaged (20*b*). This coil terminal (20) is mounted by press-fitting a press-fit engaging portion (18*b*), which is formed in the terminal base (18), in the portion to be engaged (20*b*) to establish engagement.

6 Claims, 9 Drawing Sheets

ELECTROMAGNETIC CONTACT DEVICE

RELATED APPLICATIONS

The present application is National Phase of International Application No. PCT/JP2010/003934 filed Jun. 14, 2010, and claims priority from, Japanese Application No. 2009-190584, filed Aug. 20, 2009.

TECHNICAL FIELD

This invention relates to an electromagnetic contact device, and in particular relates to a coil terminal structure having a winding wire binding portion, which connects an end portion of a winding of an electromagnetic coil, and a terminal connected to external wiring.

BACKGROUND ART

An electromagnet contact device accommodates, in a case, a contact point portion and an electromagnet which moves the contact point portion upon application of a voltage. The contact point portion comprises a movable contact point support which can move by operation of the electromagnet, a return spring, and a plurality of movable contact points, contact point springs, and fixed contact points.

An electromagnet comprises an electromagnetic coil in which windings are wound about a coil frame; a fixed core inserted into a hollow portion of the coil frame; a terminal base integrally formed at one end of the coil frame; a terminal which can be connected to external wiring; and a winding wire binding portion, which can bind and connect end portions of the windings (see for example Patent Reference 1).

FIG. 8 and FIG. 9 show the coil terminal structure of an electromagnetic contact device of the prior art.

In the structure of the prior art, a winding wire binding portion 2 is provided within a first case 1 accommodating an electromagnet, and an elastically deformable U-shape wire binding contact portion 3 is formed integrally with this winding wire binding portion 2. Further, a terminal 5 connected with external wiring is accommodated in a second case 4 connected to the first case 1, and this terminal 5 comprises a terminal plate 5*a* forming a terminal screw hole, and a terminal contact portion 5*b* which is bent at substantially a right angle from the terminal plate 5*a* and makes contact with the wire binding contact portion 3. In this structure, in a state in which the terminal contact portion 5*b* is held by a pressing force of the elastically deformed wire binding contact portion 3, the terminal 5 is electrically connected with the winding wire binding portion 2.

Patent Reference 1: Japanese Patent Application Laid-open No. 2000-90800

However, in the structure of the prior art shown in FIG. 8 and FIG. 9, the winding wire binding portion 2 and terminal 5 are separate structures, and so the increased number of components, increase in the number of assembly processes, and similar result in manufacturing cost problems.

Further, the terminal contact portion 5*b* of the terminal 5 is held only by the pressing force of the elastically deformed wire binding contact portion 3, so that if the pressing force due to elastic deformation of the wire binding contact portion 3 is small, there is the concern of escape from the second case 4, and so there is a problem of reliability.

DISCLOSURE OF THE INVENTION

And, because a structure of the prior art is a structure in which the winding wire binding portion 2 and terminal 5 are connected at the time of assembly as separate members, there has been the problem that if dirt or similar intrudes between the wire binding connection portion 3 and the terminal 5 at the time of assembly, a conduction defect may occur.

Hence the present invention focuses on the above unresolved problems of examples of the prior art, and has as an object provision of an electromagnetic contact device which enables reduction of manufacturing costs through reduction of the number of components and the number of assembly processes, and which prevents escape of terminals after assembly and has high reliability.

In order to achieve the above object, the electromagnetic contact device of one embodiment has an electromagnetic coil in which a winding is wound around a coil frame, a terminal base formed integrally with one end of the coil frame, a terminal which can be connected to external wiring, and a winding wire binding portion which can bind an end portion of the winding to establish connection, the electromagnetic contact device being characterized in that the terminal, the winding wire binding portion, and a portion to be engaged with the terminal base are integrated to form a coil terminal, and a press-fit engaging portion which, by press-fitting, engages with the portion to be engaged that is in the coil terminal.

By means of the electromagnetic contact device of this embodiment, the coil terminal comprises a terminal, winding wire binding portion, and a portion to be engaged that is formed in an integral structure, so that the number of components is reduced. Further, the coil terminal can be mounted simply by press-fitting the portion to be engaged in the press-fit engaging portion formed on the terminal base, so that the number of assembly processes is also reduced. Further, the coil terminal is an integral structure of a terminal, winding wire binding portion, and portion to be engaged, so that there exist no places for connection at the time of assembly, and connection defects do not occur.

Further, in the electromagnetic contact device of one embodiment, the press-fit engaging portion has an engaging wall which forms a press-fit space of the portion to be engaged, and the portion to be engaged has an engaging tooth which is press-fit into the engaging wall.

By means of the electromagnetic contact device of this embodiment, the portion to be engaged of the coil terminal is firmly press-fit into the press-fit engaging portion.

Further, in the electromagnetic contact device of one embodiment, a blocking portion which blocks the press-fit space in which the portion to be engaged is press-fit into the press-fit engaging portion is provided in at least one of the portion to be engaged and the press-fit engaging portion.

By means of the electromagnetic contact device of this embodiment, when the engaging tooth of the portion to be engaged is press-fit into the engaging wall of the press-fit engaging portion, shavings occur, but the shavings are sealed into the press-fit space by the blocking portion, so that removal of shavings by air cleaning or similar is unnecessary, and assembly is made still easier.

Further, in the electromagnetic contact device of one embodiment, an escape-stopping portion, which prevents escape, in a direction opposite a press-fit direction, of the coil terminal in which the portion to be engaged has been press-fit into the press-fit engaging portion, is provided.

By means of the electromagnetic contact device of this embodiment, escape of the coil terminal can be reliably prevented, so that reliability of the wiring terminal portion of the electromagnetic contact device is improved.

And, in the electromagnetic contact device of one embodiment, a second housing, in which is provided a coil terminal accommodation chamber accommodating the coil terminal, is connected to a first housing accommodating the electromagnetic coil, and a portion of the wall forming the coil terminal accommodation chamber of the second housing abuts a prescribed position of the coil terminal, and functions as the escape-stopping portion.

By means of the electromagnetic contact device of this embodiment, simply by connecting the first housing accommodating the electromagnetic coil and the second housing, a structure is obtained which prevents escape of the coil terminal.

By means of an electromagnetic contact device of this invention, a coil terminal is an integral structure of a terminal, winding wire binding portion, and portion to be engaged, so that the number of components can be reduced. Further, the coil terminal can be mounted simply by engaging the portion to be engaged in a press-fit engaging portion of a terminal base, so that the number of assembly processes is also reduced. Hence the number of components is reduced and the number of assembly processes is reduced, so that the manufacturing cost of the electromagnetic contact device can be reduced.

Further, by press-fitting the portion to be engaged of the coil terminal into the press-fit engaging portion of the terminal base, the coil terminal is firmly mounted in the terminal base, and escape of the coil terminal after assembly can be reliably prevented.

Further, the coil terminal is an integral structure of a terminal, winding wire binding portion, and portion to be engaged, so that there exist no places for connection at the time of assembly, and connection defects can be prevented.

BEST MODE FOR CARRYING OUT THE INVENTION

Figure 1:
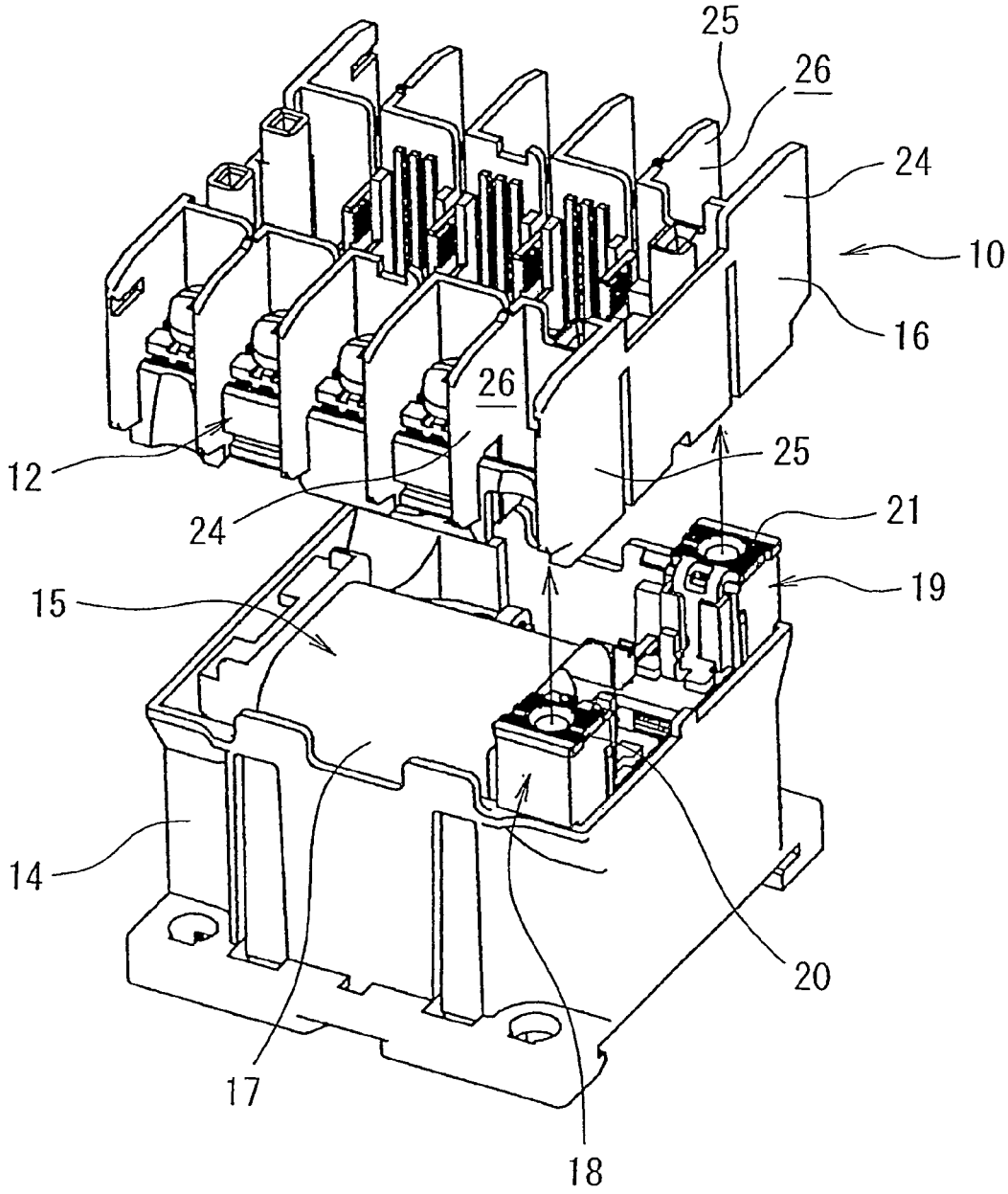
FIG. 1 is an exploded perspective view showing a lower case accommodating an electromagnet and an upper case accommodating a contact point portion of an electromagnetic contact device.

Below, preferred modes (hereafter "embodiments") for implementing an electromagnetic contact device of the invention are explained in detail referring to the drawings.

Figure 2:
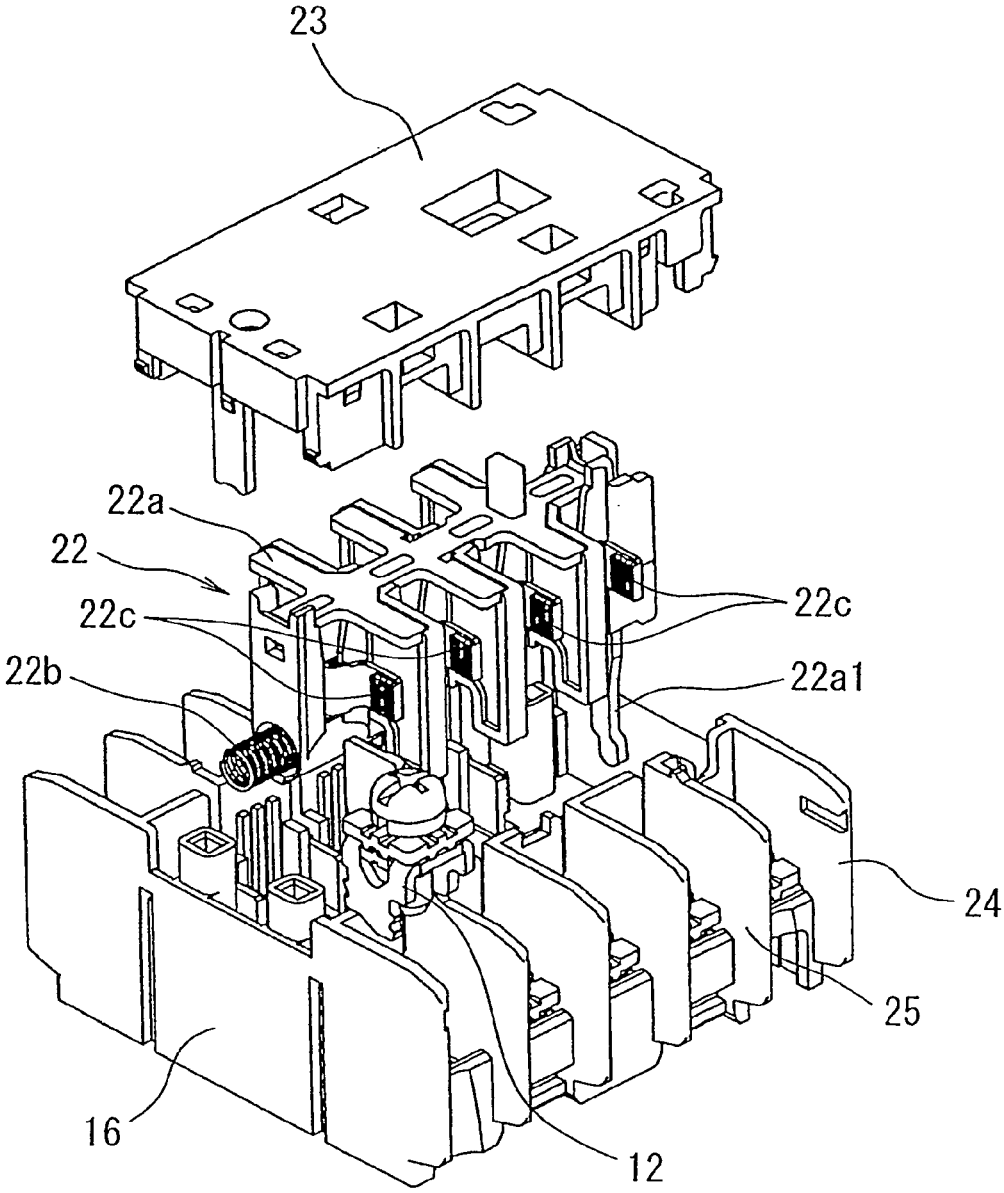
FIG. 2 is a perspective view showing the structure of an upper case accommodating a contact point portion.
Figure 3:
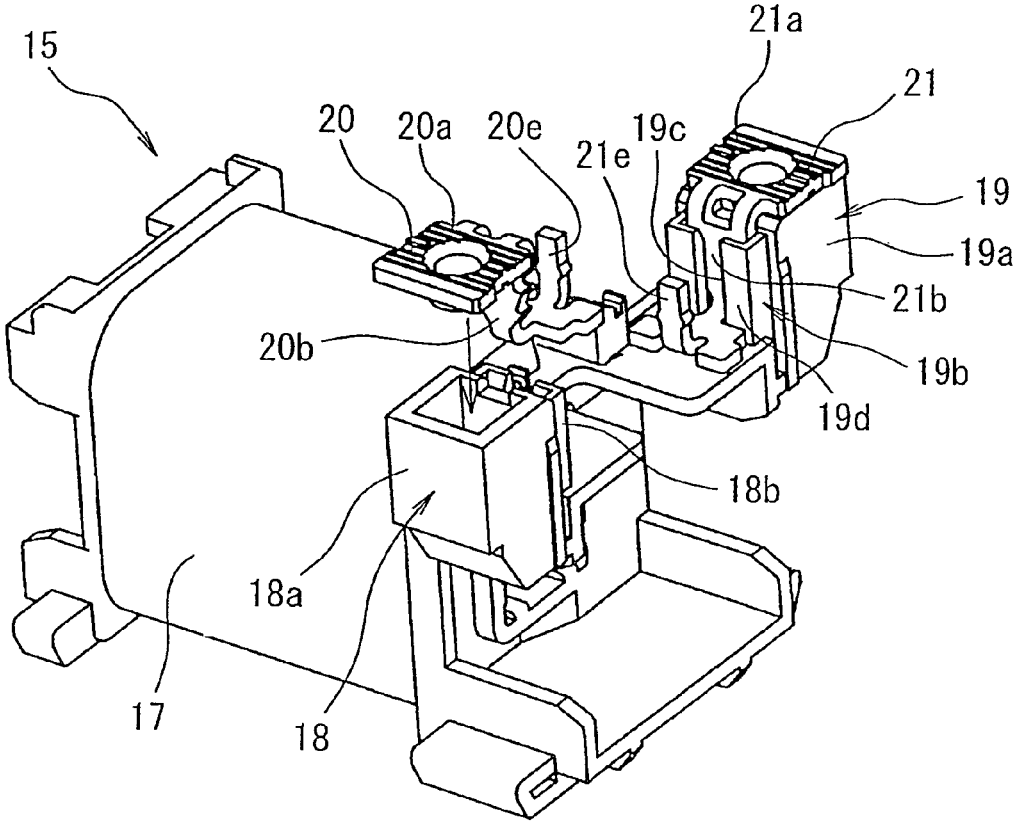
FIG. 3 is a perspective view showing the structure of an electromagnet of the invention.
Figure 4:
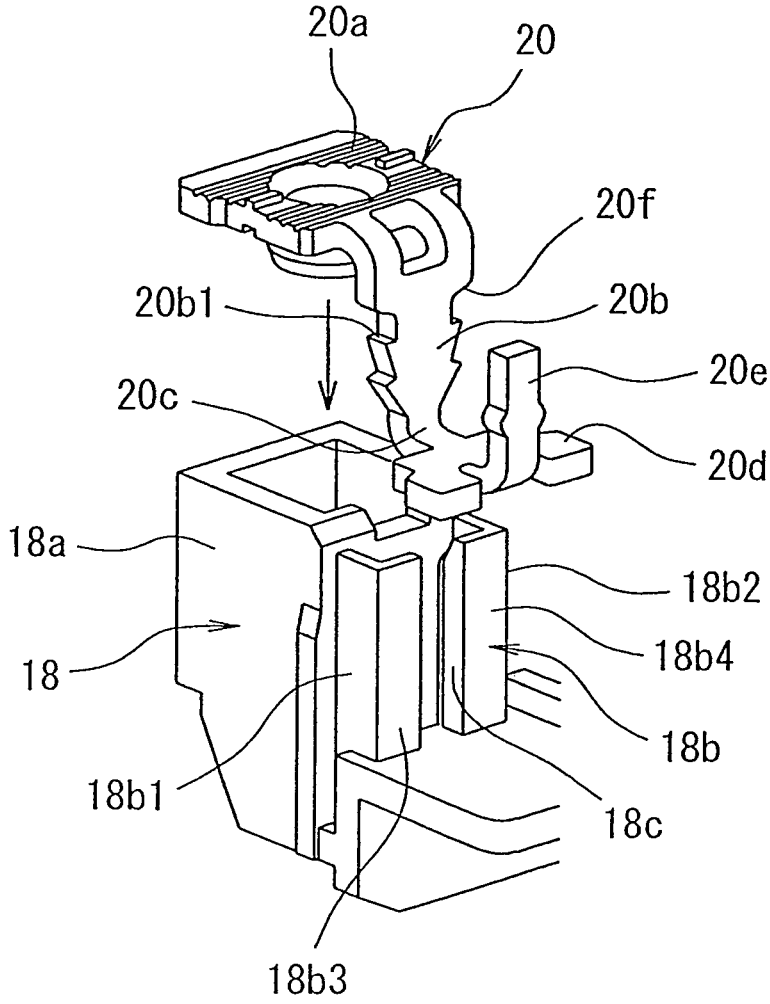
FIG. 4 is a perspective view showing the structure of a terminal base and coil terminal of the invention.
Figure 5:
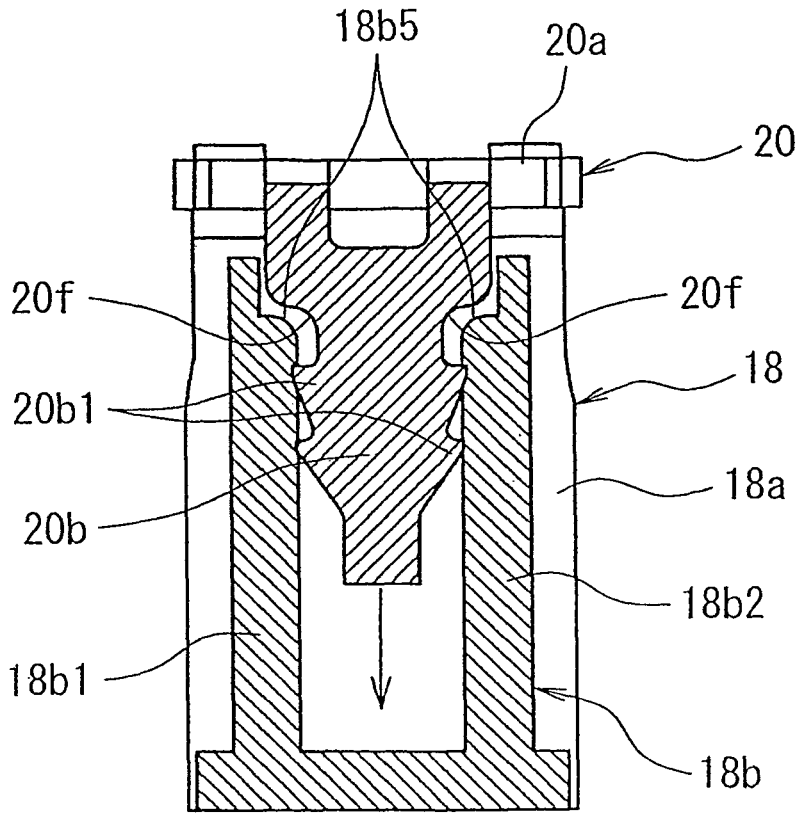
FIG. 5 shows a state in which the portion to be engaged of the coil terminal is press-fit into the press-fit engaging portion of the terminal base in FIG. 4.
Figure 6:
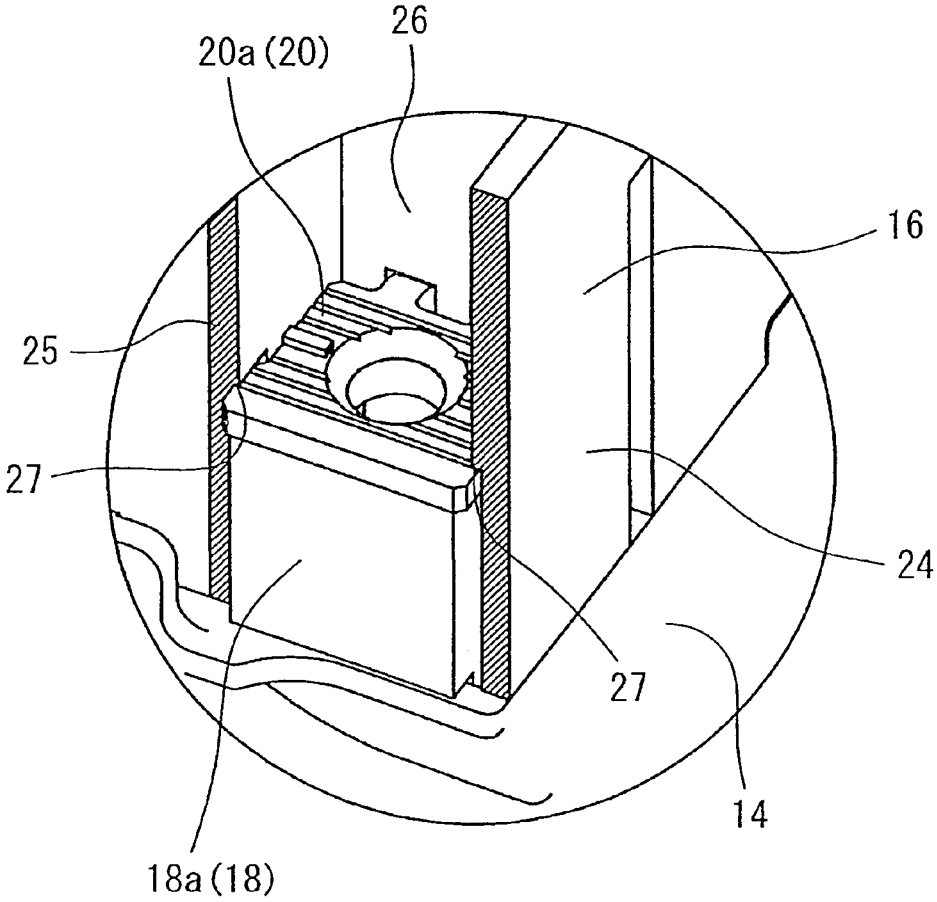
FIG. 6 is a perspective view showing a state in which a terminal base is accommodated in a coil terminal accommodation chamber of an upper case of the invention.
Figure 7:
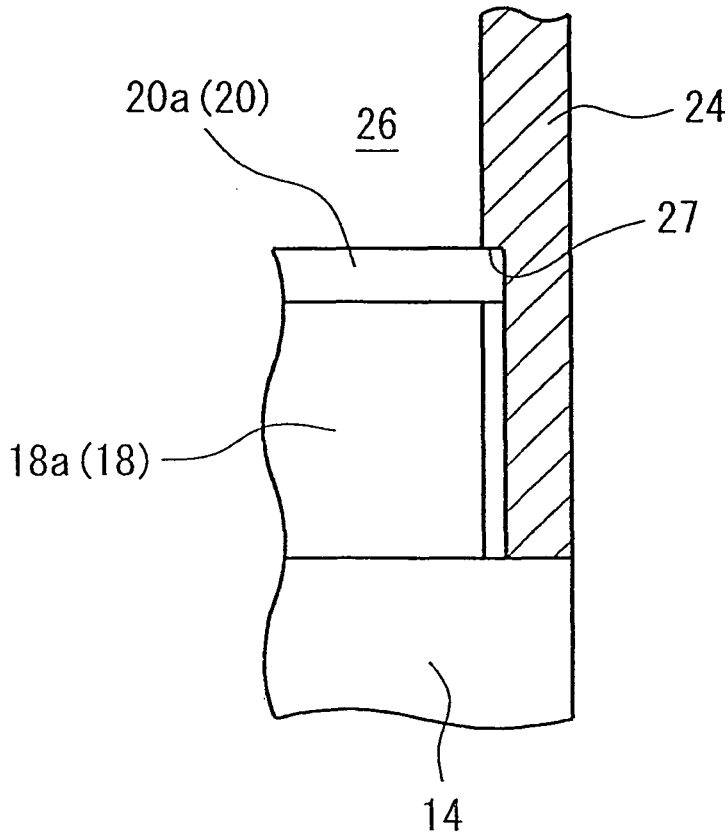
FIG. 7 shows the coil terminal escape-preventing structure of FIG. 6 in detail.
Figure 8:
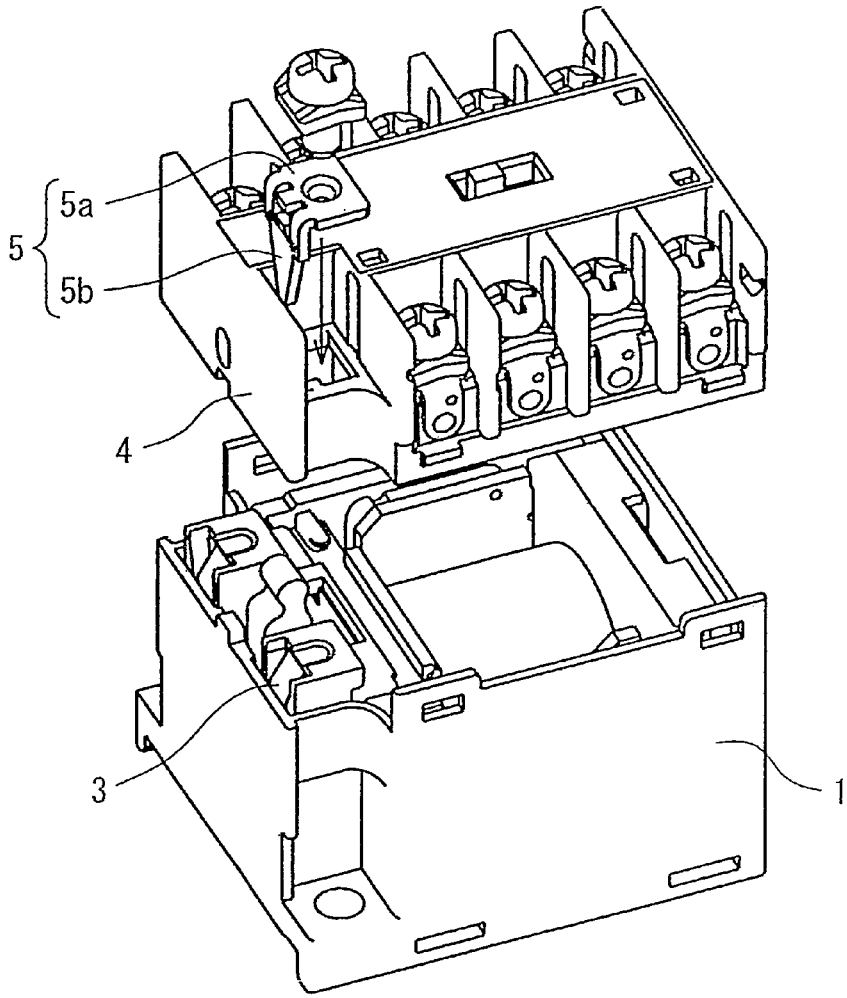
FIG. 8 Prior Art
FIG. 8 shows the configuration of an electromagnetic contact device of the prior art.
Figure 9:
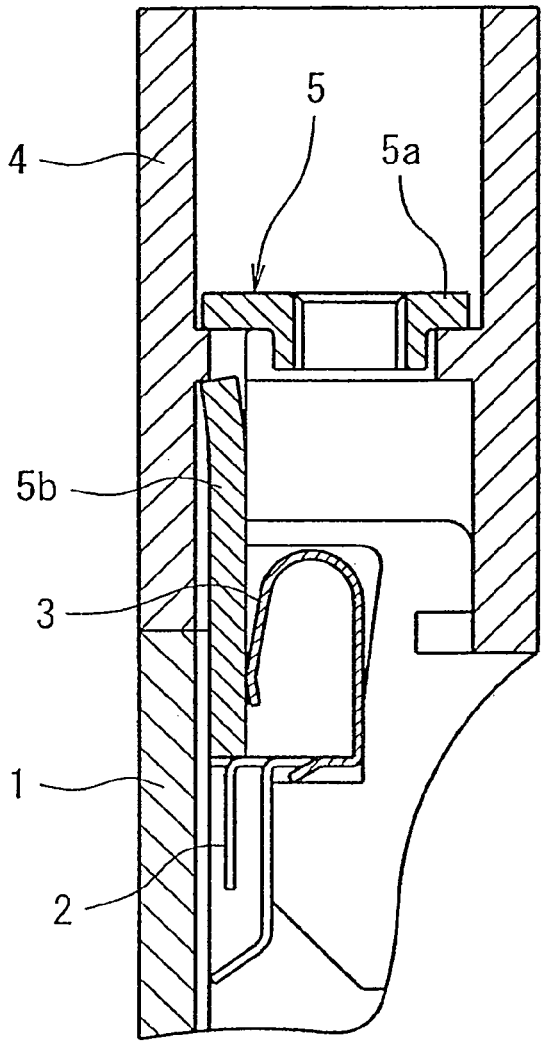
FIG. 9 Prior Art
FIG. 9 shows the connection structure of a divided terminal and winding wire binding portion in an electromagnetic contact device of the prior art.

FIG. 1 is an exploded perspective view showing a lower case accommodating an electromagnet and an upper case accommodating a contact point portion of an electromagnetic contact device; FIG. 2 is a perspective view showing the structure of an upper case accommodating a contact point portion; FIG. 3 is a perspective view showing the structure of an electromagnet; FIG. 4 is a perspective view showing the structure of a terminal base and coil terminal; FIG. 5 shows a state in which the portion to be engaged of the coil terminal is press-fit into the press-fit engaging portion of the coil terminal base; FIG. 6 is a perspective view showing a state in which a terminal base is accommodated in a coil terminal accommodation chamber of an upper case; and FIG. 7 shows in detail the coil terminal escape-preventing structure of an upper case.

As shown in FIG. 1, the electromagnetic contact device 10 of this embodiment is a device comprising terminal portions 12 each having contact points, and coil terminals 20, 21; wherein an electromagnet 15 is accommodated within a synthetic resin lower case 14, and a synthetic resin upper case 16 is mounted on the upper opening of the lower case 14. Terminal portions 12 each having contact points, arranged on the front side of the upper case 16 in FIG. 1, are load-side terminals; the terminal portions (not shown) each having contact points are also arranged on the rear side of the upper case 16, and these terminals are power supply-side terminals.

The upper case 16 accommodates a contact point portion 22 and the upper opening is covered by a cover 23 as shown in FIG. 2.

The contact point portion 22 comprises a movable contact point support 22*a* of synthetic resin, a return spring 22*b*, a plurality of movable contact points 22*c* and a plurality of contact point springs (not shown). The movable contact point support 22*a* is arranged within the upper case 16 so as to move parallel to the direction of motion of the movable core of the electromagnet 15 described below, and a driving lever 22*a*1, provided on one side in the movement direction, linkably engages the movable core. The return spring 22*b* is arranged within the upper case 16 such that an urging force acts toward one side of the movable contact point support 22*a*.

The plurality of movable contact points 22*c* are arranged within the movable contact point support 22*a*, each supported by a contact point spring (not shown), so as to enable movement in the same direction as the movable contact point support 22*a*. Further, the plurality of contact point springs are arranged such that the spring urging force acts on each movable contact point 22*c* in the direction opposite the direction of action of the spring urging force of the return spring 22*b*. And, a plurality of fixed contact points (not shown) are fixed in the upper case 16, and these fixed contact points are arranged in opposition to the direction of motion of the plurality of movable contact points 22*c*.

As shown in FIG. 3, the electromagnet 15 accommodated in the lower case 14 comprises a synthetic resin coil frame (not shown) around which is wound an electromagnetic coil 17; a fixed core (not shown), inserted into a hollow portion of this coil frame, and fixed to a side wall of the lower case 14; a movable core (not shown) opposite to the fixed core to freely contact and separate therefrom and inserted into a hollow portion of the coil frame; and a pair of coil terminal bases 18, 19 formed integrally on the side of one end of the coil frame at which the movable core is arranged and mutually separated. The movable core linkably engages the above-described driving lever 22*a*1 of the movable contact point support 22*a*.

In the electromagnetic contact device 10, when a voltage is applied and excites the electromagnetic coil 17, the movable core moves toward the fixed core, and together with movement of the movable core, the driving lever 22*a*1 moves, and the movable contact point support 22*a* moves in the direction to compress the return spring 22*b*. When the movable contact point support 22*a* moves in the direction to compress the return spring 22*b*, the plurality of movable contact points 22*c* arranged on the movable contact point support 22*a* are pressed in contact with the fixed contact points by the spring urging force of each of the contact point springs, and the plurality of movable contact points 22*c* and fixed contact points enter the closed-circuit (ON) state.

Further, when excitation of the electromagnetic coil 17 is stopped, the movable contact point support 22*a* and driving lever 22*a*1 are pushed back to the original position by the spring urging force of the return spring 22*b*, and the movable core also returns to the original position. And, when the movable contact point support 22*a* moves to the original position, the spring urging force of the plurality of contact point springs decline and the plurality of movable contact points 22*c* and fixed contact points enter the open-circuit (OFF) state.

Here, as shown in FIG. 4, one coil terminal base 18 comprises a square tube-shape portion 18*a* extending from the uppermost face of the electromagnetic coil 17 to a higher position, and a coil terminal press-fit portion 18*b* formed on the outer wall of the square tube-shape portion 18*a* opposing the other coil terminal base 19.

As shown in FIG. 4, in the coil terminal press-fit portion 18*b*, substantial L shapes are formed by a pair of plate-shape engaging portions 18*b*1, 18*b*2 protruding from the outer wall of the square tube-shape portion 18*a*, and mutually separated, and extending in the vertical direction, and a pair of plate-shape holding portions 18*b*3, 18*b*4 extending so as to approach each other from the open ends of the pair of plate-shape engaging portions 18*b*1, 18*b*2; and a neck portion pass-through slit 18*c* is formed between the plate-shape holding portion 18*b*3 and the plate-shape holding portion 18*b*4.

Further, the other coil terminal base 19 has the same structure as the one coil terminal base 18, comprising a square tube-shape portion 19*a* and a coil terminal press-fit portion 19*b*.

As shown in FIG. 4, the coil terminal 20 comprises a terminal portion 20*a*; a press-fitted piece 20*b*, bent at substantially a right angle to and extending from the terminal portion 20*a*; a neck portion 20*c* formed on an end portion of the press-fitted piece 20*b* with maximum separation from the terminal portion 20*a*; a wire binding foundation portion 20*d*, bent at substantially a right angle to the neck portion 20*c* so as to be substantially parallel to the terminal portion 20*a*; and a rising windings wire binding portion 20*e*, bent from the wire binding foundation portion 20*d* to be substantially parallel to the press-fitted piece 20*b*. And, on the press-fitted piece 20*b* are formed sawtooth-shape engaging teeth 20*b*1, which engage while being press-fit with the inner faces of the pair of plate-shape engaging portions 18*b*1, 18*b*2 of the coil terminal press-fit portion 18*b*.

Here, as shown in FIG. 5, a narrow portion 20*f* in which the width dimension is suddenly reduced is provided in the press-fitted piece 20*b* on the side of the terminal portion 20*a*, and engaging teeth 20*b*1 are formed from this narrow portion 20*f* toward the side of the neck portion 20*c*. Further, step portions 18*b*5 are formed on the upper portion of the inner faces of the pair of plate-shape engaging portions 18*b*1, 18*b*2 of the coil terminal press-fit portion 18*b*, opposing the narrow portion 20*f* of the press-fitted piece 20*b*.

Further, the other coil terminal 21 has the same structure as the one coil terminal 20, and as shown in FIG. 3, comprises a terminal portion 21*a*, press-fitted piece 21*b*, and winding wire binding portion 21*e*; on the press-fitted piece 20*b* are formed sawtooth-shape engaging teeth (not shown), which engage while being press-fit with the inner faces of the coil terminal press-fit portion 19*b*.

In the coil terminal 20 of the above configuration, the neck portion 20*c* is passed through the neck portion pass-through slit 18*c* of the coil terminal press-fit portion 18*b* and mounted while press-fitting until the terminal portion 20*a* abuts the upper edge of the square tube-shape portion 18*a*. At this time, as shown in FIG. 5, the sawtooth-shape engaging teeth 20*b*1 of the press-fitted piece 20*b* are engaged while being press-fitted into the inner faces of the pair of plate-shape engaging portions 18*b*1, 18*b*2 of the coil terminal press-fit portion 18*b*. And, when the terminal portion 20*a* abuts the upper edge of the square tube-shape portion 18*a*, the narrow portion 20*f* of the press-fitted piece 20*b* opposes the step portions 18*b*5 of the coil terminal press-fit portion 18*b*.

Similarly, in the coil terminal 21, the neck portion (not shown) is also passed through the neck portion pass-through slit 19*c* of the coil terminal press-fit portion 19*b* and mounted while press-fitting until the terminal portion 21*a* abuts the upper edge of the square tube-shape portion 19*a*, and the saw tooth-shape portion to be engaged of the press-fitted piece 21*b* are engaged while being press-fitted into the inner faces of the coil terminal press-fit portion 19*b*. And, although not shown, when the terminal portion 21*a* abuts the upper edge of the square tube-shape portion 19*a*, the narrow portion of the press-fitted piece 21*b* opposes the step portions of the coil terminal press-fit portion.

Then, one wire end of the electromagnetic coil 17 wound around the coil frame is wound onto the winding wire binding portion 20*e* of the coil terminal 20, and the other wire end of the electromagnetic coil 17 is wound around the winding wire binding portion 21*e* of the coil terminal 21.

The coil terminal bases 18, 19 of the electromagnet 15 on which the coil terminals 20, 21 are press-fit mounted as in the above configuration are accommodated in the coil terminal accommodation chamber 26 between a pair of partition walls 24, 25 provided on the upper case 6 as shown in FIG. 1.

Here, as shown in FIG. 6 and FIG. 7, when the coil terminal base 18 is accommodated in the coil terminal accommodation chamber 26, an escape-stopping portion 27 formed in the inner walls of the pair of partition walls 24, 25 abuts the upper face of the terminal portion 20*a* of the coil terminal 20. Further, although not shown, when the coil terminal base 19 is accommodated in the coil terminal accommodation chamber 26, an escape-stopping portion 27 formed in the inner walls of the pair of partition walls 24, 25 abuts the upper face of the terminal portion 21*a* of the coil terminal 21.

The first housing of this invention corresponds to the lower case 14, the second housing of this invention corresponds to the upper case 16, the terminal base of this invention corresponds to the coil terminal bases 18 and 19, the terminal of this invention corresponds to the terminal portions 20*a* and 21*a*, the portion to be engaged of this invention corresponds to the press-fitted pieces 20*b* and 21*b*, the press-fit engaging portion of this invention corresponds to the coil terminal press-fit portions 18*b* and 19*b*, the engaging wall of this invention corresponds to the plate-shape engaging portions 18*b*1 and 18*b*2, the engaging tooth of this invention corresponds to the engaging teeth 20*b*1, the blocking portion of this invention corresponds to the step portion 18*b*5 of the coil terminal press-fit portion 18*b* and the narrow portion 20*f* of the press-fitted piece 20*b*, and the escape-stopping portion of this invention corresponds to the escape-stopping step portion 27.

By means of an electromagnetic contact device with the above configuration, the coil terminals 20 and 21 are structures integrating terminal portions 20*a*, 21*b*, winding wire binding portions 20*e*, 21*e*, and press-fitted pieces 20*b*, 21*b*, so that an increase in the number of components can be prevented. Further, the coil terminals 20, 21 are mounted simply by press-fitting the press-fitted pieces 20*b*, 21*b* into the coil terminal press-fitting portions 18*b*, 19*b* formed in the coil terminal bases 18, 19, so that the number of assembly processes is reduced. Hence the number of components is reduced and the number of assembly processes is also reduced, so that the manufacturing cost of the electromagnetic contact device can be reduced.

Further, the coil terminal 20 is mounted while press-fitting the press-fitted piece 20*b* in the coil terminal press-fitting portion 18*b*, and the engaging teeth 20*b*1 of the press-fitted piece 20*b* engage with the inner faces of the pair of plate-shape engaging portions 18*b*1, 18*b*2 of the coil terminal press-fitting portion 18*b* while being press-fitted. In the similar way, the engagement of the coil terminal 21 is established inside the coil terminal press-fitting portion 19*b*. Hence the coil terminals 21, 21 can be firmly press-fit into the coil terminal press-fit portions 18*b*, 19*b*.

Here, when press-fitting the coil terminal 20 into the coil terminal press-fit portion 18*b*, shavings occur due to press-fitting and engagement of the engaging teeth 20*b*1 with the pair of plate-shape engaging portions 18*b*1, 18*b*2 of the coil terminal press-fit portion 18*b*; but when the terminal portion 20*a* abuts the upper end of the square tube-shape portion 18*a*, the narrow portion 20*f* formed in the press-fitted piece 20*b* opposes the step portions 18*b*5 formed in the coil terminal press-fit portion 18*b*, and the shavings which occur are sealed within the coil terminal press-fit portion 18*b*. Further, the coil terminal 21 and coil terminal press-fit portion 19*b* undergo a similar operation. Hence shavings do not intrude into the contact point portion 22 and similar, and removal by air cleaning and similar is unnecessary, so that assembly is made even easier.

Further, when the coil terminal base 18 is accommodated in the coil terminal accommodate chamber 26 of the upper case 16, the escape-stopping step portion 27 formed in the inner walls of the pair of partition walls 24, 25 abuts the upper faces of the terminal portions 20*a*, 21*a* of the coil terminals 20, 21, so that escape of the coil terminals 20, 21 can be reliably prevented, and a highly reliable electromagnetic contact device 1 can be provided.

And, by means of a simple structure obtained merely by forming the escape-stopping step portion 27 in the inner walls of the pair of partition walls 24, 25, escape of the coil terminals 20, 21 can easily be prevented.

INDUSTRIAL APPLICABILITY

As explained above, an electromagnetic contact device of this invention is effective to reduce the manufacturing costs by enabling reduction of the number of components and the number of assembly processes, and to improve reliability by preventing escape of terminals after assembly.

EXPLANATION OF REFERENCE NUMERALS

10 Electromagnetic contact device
12 Terminal portion
14 Lower case
15 Electromagnet
16 Upper case
17 Electromagnetic coil
18, 19 Coil terminal base
18*a* Square tube-shape portion
18*b* Coil terminal press-fit portion
18*b*1, 18*b*2 Plate-shape engaging portion
18*b*3, 18*b*4 Plate-shape holding portion
18*b*5 Step portion
18*c* Neck portion pass-through slit
19*a* Square tube-shape portion
19*b* Coil terminal press-fit portion
19*c* Neck portion pass-through slit
20, 21 Coil terminal
20*a* Terminal portion
20*b* Press-fitted piece
20*b*1 Engaging tooth
20*c* Neck portion
20*d* Foundation portion
20*e* Winding wire binding portion
20*f* Narrow portion
21*a* Terminal portion
21*b* Press-fitted piece
21*e* Winding wire binding portion
22 Contact point portion
22*a* Movable contact point support
22*a*1 Driving lever
22*b* Return spring
22*c* Movable contact point
23 Cover
24, 25 Partition wall
26 Coil terminal accommodation chamber
27 Escape-stopping step portion

What is claimed is:

1. An electromagnetic contact device, comprising:

an electromagnetic coil having a winding wound around a coil frame, a terminal base formed integrally with one end of the coil frame and including a press-fit engaging portion having engaging walls apart from each other, holding portions extending laterally from the engaging walls in a direction close to each other, a press-fit space defined by the engaging walls and the holding portions, and a slit formed between the holding portions, and a coil terminal formed as one member, and including a terminal portion connectable to an external wiring, a press-fitted portion extending downwardly from the terminal portion and having engaging teeth formed on side portions thereof facing the engaging walls, a foundation portion extending outwardly from the press-fitted portion in a direction substantially parallel to the terminal portion and having a neck portion at one end portion thereof to pass through the slit, and a winding wire binding portion bent upwardly from the foundation portion substantially parallel to the press-fitted portion, the winding wire binding portion being connectable to an end portion of the winding by binding, wherein the press-fit engaging portion engages the press-fitted portion by press fitting such that the engaging teeth engage the engaging walls in the press-fit space.

2. An electromagnetic contact device according to claim 1, wherein at least one of the press-fitted portion or the press-fit engaging portion includes a blocking portion forming a blocked space in the press-fit space.

3. An electromagnetic contact device according to claim 1, wherein the press-fit engaging portion includes an escape-stopping portion preventing escape in a direction opposite a press-fit direction of the coil terminal.

4. An electromagnetic contact device according to claim 3, wherein a second housing having a coil terminal accommodation chamber accommodating the coil terminal is connected to a first housing accommodating the electromagnetic coil, and the coil terminal accommodation chamber of the second housing has a wall portion abutting against a prescribed position of the coil terminal, and functioning as the escape-stopping portion.

5. An electromagnetic contact device according to claim 1, wherein the press-fitted portion includes a portion having a width narrower than other portions thereof, and the engaging walls include step portions respectively formed on inner faces thereof to contact the narrow portion in the press-fit space.

6. An electromagnetic contact device according to claim 1, wherein the engaging teeth respectively include a plurality of teeth portions formed on the side portions thereof.

* * * * *